US006874771B2

(12) United States Patent
Birdsell et al.

(10) Patent No.: US 6,874,771 B2
(45) Date of Patent: Apr. 5, 2005

(54) HUMIDIFIER WITH A HEATING DISC

(75) Inventors: Walter G. Birdsell, Marlborough, MA (US); David Feer, Wilton, NH (US); William J. Montague, Jr., Upton, MA (US)

(73) Assignee: Kaz, Inc., New York, NY (US)

( * ) Notice: Subject to any disclaimer, the term of this patent is extended or adjusted under 35 U.S.C. 154(b) by 28 days.

(21) Appl. No.: 10/216,103

(22) Filed: Aug. 9, 2002

(65) Prior Publication Data

US 2004/0026802 A1 Feb. 12, 2004

(51) Int. Cl.[7] ..... B01F 3/04

(52) U.S. Cl. ..... 261/131; 261/142; 261/72.1; 261/DIG. 65

(58) Field of Search ..... 261/72.1, 73, 130, 261/131, 133, 142, DIG. 10, DIG. 29, DIG. 65

(56) References Cited

U.S. PATENT DOCUMENTS

| | | | | | |
|---|---|---|---|---|---|
| 4,203,027 | A | * | 5/1980 | O'Hare et al. | 392/390 |
| 4,325,344 | A | * | 4/1982 | Igashira et al. | 123/549 |
| 4,338,363 | A | * | 7/1982 | Gill et al. | 427/387 |
| 4,657,713 | A | * | 4/1987 | Miller | 261/142 |
| 4,753,758 | A | * | 6/1988 | Miller | 261/139 |
| 4,819,625 | A | * | 4/1989 | Howe | 128/200.18 |
| 4,869,853 | A | * | 9/1989 | Chen | 261/142 |
| 4,943,704 | A | * | 7/1990 | Rabenau et al. | 392/386 |
| 5,361,322 | A | * | 11/1994 | Glucksman | 392/405 |
| 5,492,602 | A | * | 2/1996 | Vogelman et al. | 202/181 |
| 6,220,579 | B1 | * | 4/2001 | Chen | 261/131 |
| 6,554,260 | B1 | * | 4/2003 | Lipscombe et al. | 261/142 |

FOREIGN PATENT DOCUMENTS

JP 5-223295 * 8/1993

* cited by examiner

*Primary Examiner*—Scott Bushey
(74) *Attorney, Agent, or Firm*—Darby & Darby

(57) ABSTRACT

A humidifier includes a base defining a reservoir for retaining liquid, a humidification device for inducing dispersion of liquid withdrawn from the reservoir into the environment and a liquid storage tank having an outlet for feeding liquid into the reservoir. The humidification device includes a heated disc for evaporating a stream of liquid delivered from the reservoir to the heated disc by a delivery mechanism. The delivery mechanism may deliver the stream of liquid as a mist, a thin film or a controlled stream of liquid onto the disc.

28 Claims, 7 Drawing Sheets

HUMIDIFIER WITH A HEATING DISC

FIELD OF THE INVENTION

This invention relates to humidifiers, and more specifically, to a humidifier with an improved humidification device including a heatable disc.

BACKGROUND OF THE INVENTION

Various types of humidifiers are used to provide moisture to indoor air. Included among such humidifiers are steam humidifiers, ultrasonic humidifiers, porous medium humidifiers and evaporative humidifiers. Many humidifiers employ a removable water storage tank, which can be removed for filling. Typically, a bottom wall of the storage tank is provided with a valve assembly that regulates water flow to maintain a desired water level in a reservoir supplying a humidification device.

Steam humidifiers include a water storage tank and an electric heating element submerged in water to generate steam. Safety devices are provided for switching off the current as soon as the water level drops below the heating element. A flow of hot steam is blown directly into the room to be humidified. As the steam is hot, it may pose a danger to people who come into contact with the steam, or who accidentally overturn the container of hot water. Moreover, in order for the steam to be generated the water must first be boiled. This process may take time and the user may not know whether the device is working, while they wait for steam to be generated.

Ultrasonic humidifiers generally include a container filled with water that is brought to vibration by a high-frequency vibrator, which causes the water to be atomized. An air stream directed onto the water surface carries the mist into the room to be humidified. As the water is not boiled, ultrasonic humidifiers are susceptible to the growth of microorganisms, which may be subsequently carried by the air stream into the room being humidified.

Porous medium humidifiers generally include a porous medium structure partly submerged in cold water in an open vessel and a blower unit drawing air through the porous medium structure. The porous medium may be in the shape of a disc, a drum or a rectangle with part of the medium dipped into the water, which is slowly rotated while air is blown through the portion of the medium above the water level, thus carrying humidity into the room. The porous medium may also be in the form of a stationary body adapted to draw water into the upper non-immersed part by capillary action, it is then carried into the room by air blown therethrough. As the water is not boiled, this method can also lead to the growth of microorganisms, which may be subsequently carried by the air stream into the room being humidified.

Warm-air humidifiers include a container with water, a heated evaporation chamber and a fan adapted for dispersing the generated steam into the room via a passageway. Warm-air humidifiers forestall the growth of bacteria, because the water is heated to the boiling point, but avoid hot steam entering the room by mixing the steam with air which forms a mist, the temperature of which may be determined by the steam to air ratio. However, in order for the steam to be generated the water must be boiled. Because boiling must occur, this method may take time and the user may not know whether the device is working. This type of humidifier may also be complex and expensive.

SUMMARY OF THE INVENTION

According to one aspect of the invention, a humidifier is disclosed having a base defining a reservoir for retaining liquid, a heatable disc having a surface for receiving a stream of liquid from the reservoir on the surface of the disc, and a mechanism for delivering the stream of liquid from the reservoir to the disc. The disc is constructed and arranged to evaporate at least a portion of the stream of liquid withdrawn from the reservoir and discharge the moisture into the environment.

In one embodiment, the disc is angled below a horizontal plane from a portion of the disc receiving the stream of liquid. The angle may be less than about 10°. The angle may be about 2.5°. At least a portion of the disc may be connected to the base adjacent to where the disc receives the stream of liquid. The disc may have an edge and the entire edge of the disc may be connected to the base. A gasket may hold the disc to the base. The disc may be held to the base by a friction fit. The surface of the disc may be a top surface. An extended portion may be provided on the disc to move the surface of the disc closer to a plane through which the stream of liquid from the reservoir substantially flows.

In another embodiment, the disc may be stainless steel. The disc may have a surface that includes a coating. The disc may be substantially round. At least a portion of the disc may be substantially flat. The disc may include an electrical resistance coil and the coil may be connectable to an electrical source for heating at least a portion of the surface of the disc. The disc may be constructed and arranged to have a cleaning mode for spiking the temperature of at least a portion of the surface of the disc. The disc may automatically enter the cleaning mode when the reservoir is empty. The disc may be constructed and arranged to automatically shut-off the heat when at least a portion of the surface of the disc reaches a predetermined temperature.

In one embodiment, the mechanism for delivering the stream of liquid may include a passageway provided between the reservoir and the disc. The passageway may include a labyrinth. The mechanism for delivering the stream of liquid may include an atomizer. The liquid received on the surface of the disc may have a depth and the depth may be at least less than about 8 mm. The mechanism for delivering the stream of liquid may deliver at least a portion of the stream of liquid as a mist, a thin film or a controlled stream. The liquid not evaporated on the disc may be returned to the reservoir. A nozzle may be provided above the disc to direct the evaporated liquid through the nozzle. A venturi may be provided to release the evaporated liquid out of the humidifier. A liquid storage tank may be provided having an outlet communicating with the reservoir and adapted to feed liquid thereto. The tank may be removably provided on the base.

According to another aspect of the invention, a humidifier is disclosed having a mechanism for delivering a stream of liquid, and a heatable disc having a surface for receiving the stream of liquid. The disc is capable of evaporating at least a part of the stream of liquid from a portion of the surface of the disc and discharging the moisture into the environment.

In one embodiment, the disc may be angled away from a plane from the portion of the disc receiving the stream of liquid. The plane may be horizontal and the disc may be angled below the horizontal plane. The angle may be less than about 10°. The angle may be about 2.5°. A base may be provided defining a reservoir for storing liquid to feed the stream of liquid. The mechanism for delivering the stream of liquid may include a passageway provided between the reservoir and the disc. The passageway may include a labyrinth. At least a portion of the disc may be connected to the base adjacent to where the disc receives the stream of liquid. An extended portion may be provided on the disc and connected to the base to move the surface of the disc closer to a plane through which the stream of liquid from the reservoir substantially flows. The disc may have an edge and the entire edge of the disc may be connected to the base. A gasket may hold the disc to the base. The disc and gasket may be held to the base by a friction fit.

In one embodiment, a liquid storage tank may be provided having an outlet communicating with the reservoir and adapted to feed liquid thereto. The tank may be removably provided on the base. The mechanism for delivering the stream of liquid includes an atomizer. The mechanism for delivering the stream of liquid delivers at least a portion of the stream as a mist, a thin film or a controlled stream. The liquid received on the surface of the disc may have a depth and the depth may be at least less than about 8 mm. The disc may include an electrical resistance coil and the coil may be connectable to an electrical source for heating at least a portion of the surface of the disc. The disc may be constructed and arranged to have a cleaning mode for spiking the temperature of at least a portion of the surface of the disc. The disc may automatically enter the cleaning mode when the reservoir is empty. The disc may be constructed and arranged to automatically shut-off the heat when at least a portion of the disc reaches a predetermined temperature. A nozzle may be provided above the disc to direct the evaporated liquid through the nozzle. A venturi may be provided to release the evaporated liquid out of the humidifier. The surface of the disc may be a top surface.

According to yet another aspect of the invention, a method of humidification is disclosed having the steps of providing a disc having a surface, heating at least a portion of the surface the disc to a desired temperature, directing a stream of liquid onto the heated surface of the disc, evaporating at least a portion of the liquid on the surface of the disc, and releasing the evaporated liquid into the environment.

In one embodiment, the method may include the step of spiking the temperature of at least a portion of the surface of the disc for a cleaning mode. The step of spiking the temperature may be started when the stream of liquid stops. The method may include the step of stopping the heating of the disc when at least a portion of the surface reaches a predetermined temperature. The method may include the step of providing an atomizer for directing the stream of liquid onto the disc. The method may include the step of providing a base defining a reservoir for retaining the liquid that forms the stream. The method may include the step of providing a passageway between the reservoir and the disc for directing the stream of liquid onto the disc. The passageway may include a labyrinth.

In another embodiment, the method may include the steps of collecting and returning unevaporated liquid to the reservoir. At least a portion of the disc may be connected to the base adjacent to where the disc receives the stream of liquid. The method may include the step of connecting an entire edge of the disc to the base. The method may include the step of providing a liquid storage tank for delivering liquid to the reservoir. The tank may be removably connected to the reservoir. The surface of the disc may be a top surface. The disc may be angled away from a plane from a portion of the disc receiving the stream of liquid. The plane may be horizontal and the disc may be angled below the horizontal plane. The liquid received on the surface of the disc may have a depth and the depth may be at least less than about 8 mm. At least a portion of the stream of liquid may be provided as a mist, a thin film or a controlled stream. The method may include the steps of directing the evaporated liquid through a nozzle provided above the disc to a venturi, and releasing the evaporated liquid from the venturi out of the humidifier.

BRIEF DESCRIPTION OF THE DRAWINGS

The objects, advantages and features of aspects of the invention will be more clearly appreciated from the following detailed description, when taken in conjunction with the accompanying drawings, wherein like numbers are used for like features, in which.

DETAILED DESCRIPTION

As discussed above, illustrative embodiments in accordance with the invention provide a humidifier with a humidification unit that provides steam without having to boil a large quantity of liquid, thus resulting in a shorter time to produce steam. The humidification unit is provided on a base defining a liquid reservoir. The humidification unit features a heatable disc that receives a stream of liquid from the reservoir. At least a part of the stream of liquid on the disc evaporates into the air to humidify the environment. The heatable disc and stream of liquid may be provided in numerous different embodiments, a few of which will be discussed herein.

Figure 1:
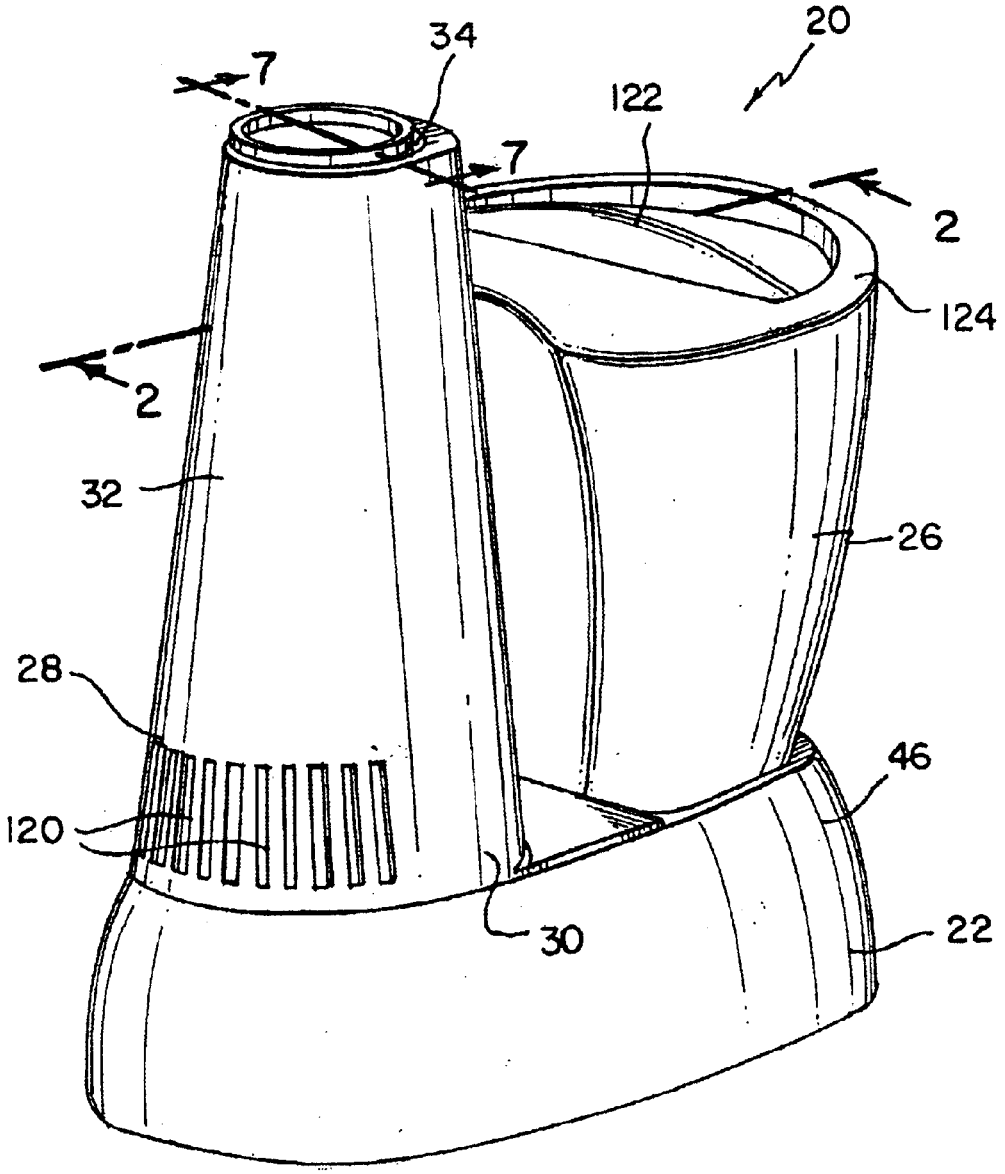
FIG. 1 is a front perspective view of a humidifier according to the invention.
Figure 2:
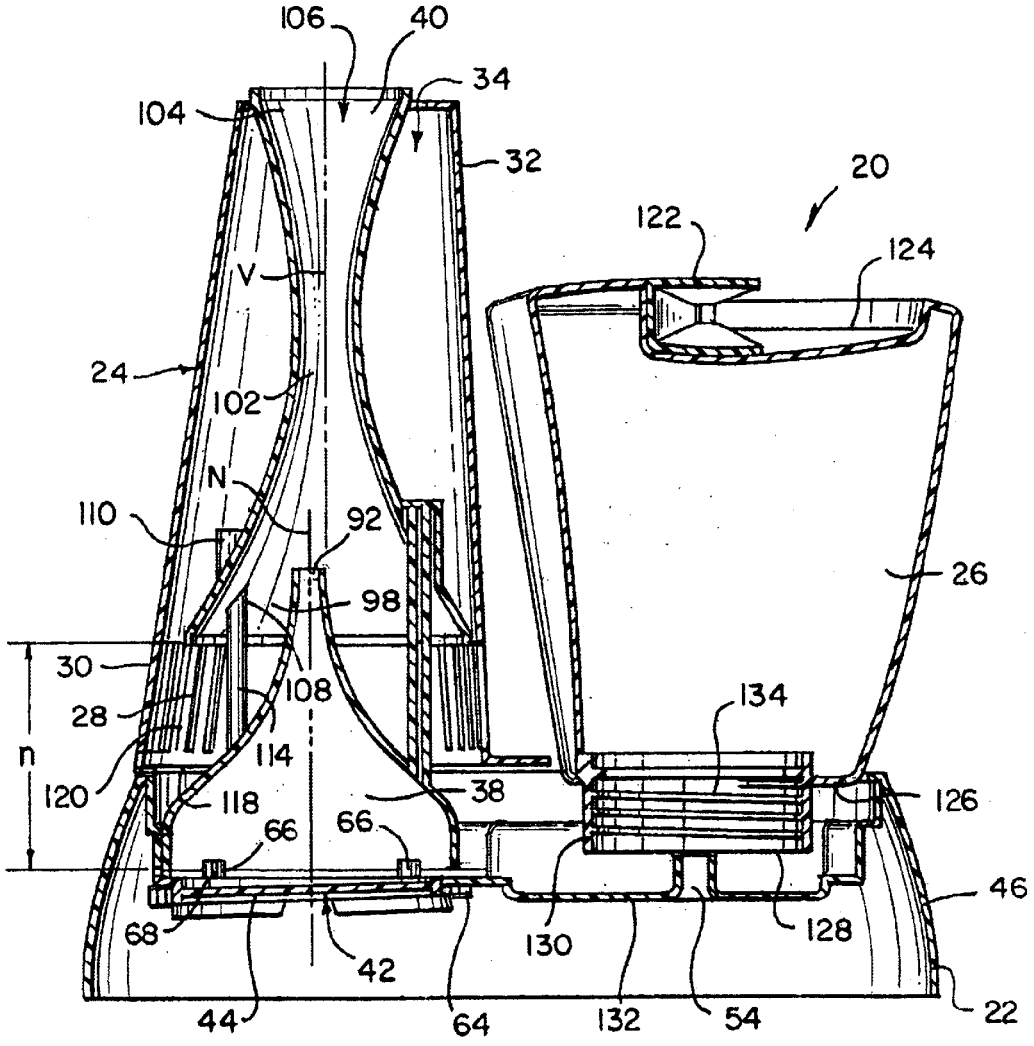
FIG. 2 is a cross-sectional view of the humidifier of FIG. 1 taken along line 2—2.
Figure 7:
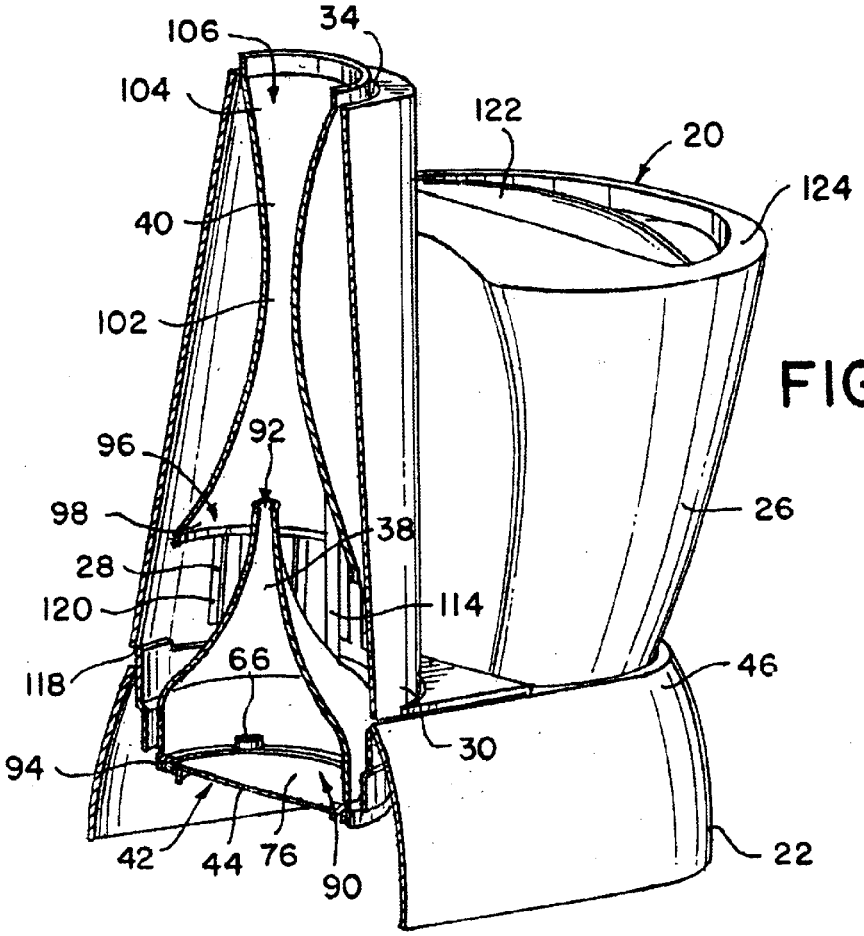
FIG. 7 is a perspective cross-sectional view of the humidifier of FIG. 1 taken along line 7—7.

Referring now to FIGS. 1–2 and 7, a humidifier 20 according to the present invention illustrated. The humidifier 20 includes a base 22. Mounted in juxtaposed positions on the base 22 are a humidification unit 24 and a removable liquid storage tank 26. The humidifier 20 has an air inlet 28 formed in a lower portion 30 of a housing 32 of the humidification unit 24 and an outlet 34 for dispersing evaporated liquid or moisture into a surrounding environment. The base 22 defines an internal reservoir 36 that receives liquid gradually discharged by the storage tank 26. The reservoir 36 and storage tank 26 may be of any conventional type, as discussed further herein.

Figure 6:
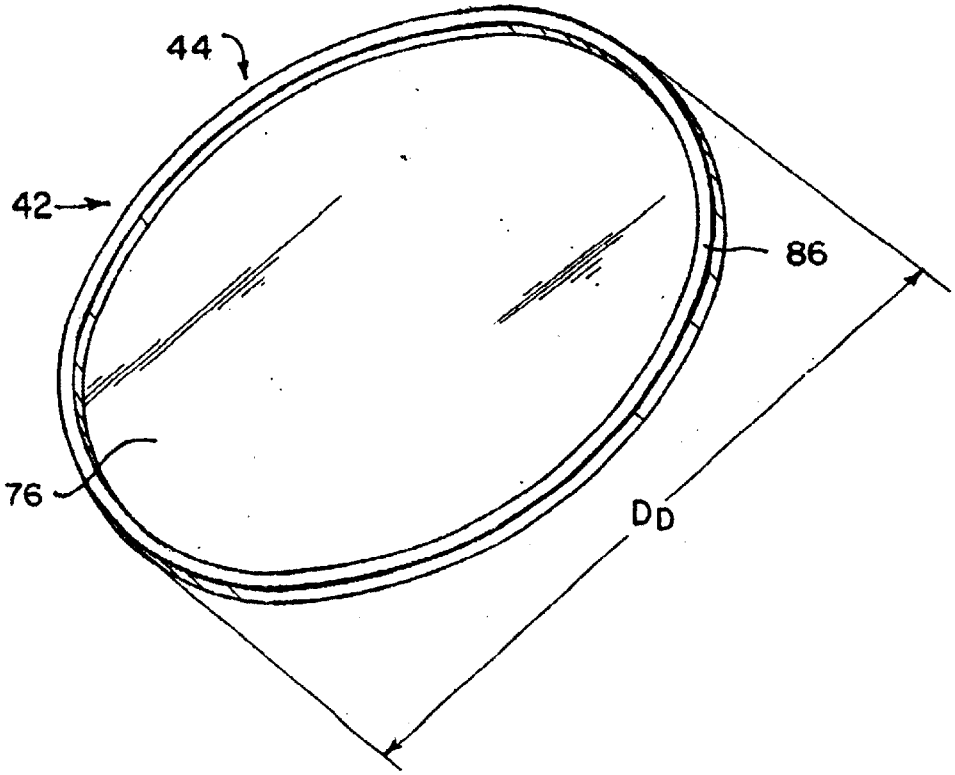
FIG. 6 is a top perspective view of a disc of the humidifier of FIG. 2.

The humidification unit 24 features a nozzle 38 placed underneath a venturi 40 (see FIG. 7), both which are well known in the art for directing and releasing the evaporated liquid into the surrounding environment. As shown in FIGS. 2, 6 and 7, a humidification device 42 includes a heatable plate or disc 44. Generally, the disc 44 is heated to a predetermined temperature when the humidifier 20 is turned on and the stream of liquid flows from the reservoir 36 in the base 22 over the disc 44. At least a portion of the liquid flowing on the disc 44 evaporates and is released out of the humidifier 20 to humidify a room or other area.

Referring now to FIG. 6, the humidification device 42 including the disc 44 according to the invention will be discussed. As shown, the disc 44 is a round, thin disc, although the disc 44 may have any suitable shape, size and thickness. For example, the disc 44 may be elliptical, square or rectangular. The disc 44 may have any suitable thickness. As shown, the disc 44 is thin, such that the weight of the disc 44 may be reduced. Preferably, the top surface 76 of the disc 44 is substantially flat. The disc 44 may be made of stainless steel. Preferably, the disc 44 is made of a high-grade stainless steel that will resist rusting from exposure to the liquid. The disc 44 may include a coating on at least a top surface 76 of the disc 44 to assist in preventing the material of the disc 44 from rusting and to allow minerals or other deposits caused by the liquid to be more easily removed from the surface of the disc. Any suitable coating may be used, for example polytetrafluoroethylene (PTFE).

As shown in FIGS. 6–11, the disc 44 has an outer edge 78 along its circumference, and a diameter $D_D$ and a thickness $T_D$. A gasket 86 is shown provided around the circumference of the disc. Preferably, the disc 44 has a thickness $T_D$ of one-quarter inch or less. The disc 44 includes a heating mechanism to heat the disc 44 to a desired temperature for evaporating liquid that flows onto the disc. The heating mechanism may be an electrical resistance coil 87 connected to a bottom surface 80 of the disc 44 and connectable to a source of electricity, for example through a wire and plug from the base 22 to standard wall outlet (not shown). The electrical resistance coil 87 may be connected to the disc 44 by any suitable means, for example glue or adhesive. It will be appreciated that any suitable heating mechanism may be used to heat at least a portion of the disc 44. Preferably, the diameter $D_D$ of the disc 44 is about 80 mm, and the thickness $T_D$ is about 1.5 mm, although it will be understood that the disc may have any suitable size. The wattage of the disc may be selected to evaporate a certain amount of liquid on the disc in a predetermined amount of time.

The stream of liquid may be delivered to the disc 44 by a delivery mechanism 69. The delivery mechanism 69 may be any suitable mechanism to deliver liquid onto the disc 44. For example, the stream of liquid may be delivered as a controlled stream, a mist, a waterfall or a thin film onto or across the disc 44. It will be appreciated that although the disc is illustrated receiving the liquid on the top surface 76 of the disc 44, the disc may receive the liquid on any suitable surface of the disc, including the bottom surface 80.

Figure 12:
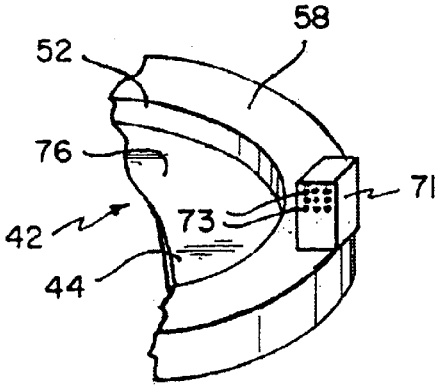
FIG. 12 is a perspective view of another embodiment of the humidification device and a delivery mechanism according to the invention.

Suitable delivery mechanisms 69 may include a nozzle, jet or valve to deliver liquid from the reservoir 36 to the disc 44. As shown in FIG. 12, an atomizer 71 may be used to deliver liquid in a fine mist or spray onto the disc 44. The atomizer 71 may feature small holes 73 to expel liquid in a fine mist. The atomizer 71 is illustrated provided next to the disc 44 to mist liquid across and onto the disc 44. However, it will be appreciated that the atomizer 71 may be provided in any suitable location, for example above the disc 44 to mist liquid onto the disc from above. Alternately, if the reservoir 36 is provided external to the humidifier 20, the liquid may be delivered in a stream to the disc 44 by tubing (not shown). The height of the tubing may dictate the height of the liquid flowing onto the disc 44. The delivery mechanism 69 may also include a channel or passageway 70 from the reservoir 36 to deliver the stream of liquid to the disc 44. The passageway 70 may be straight or may have curves. The passageway 70 may feature an entrance 73 to the passageway 70 and an exit 74 to the disc 44. The passageway 70 may be flat or horizontal, or the passageway 70 may be provided at an angle to assist in directing flow liquid to the disc 44. The passageway may be any suitable length.

Preferably, the delivery mechanism 69 results in a controlled stream, fine mist or spray or a thin film of liquid on the disc 44 such that the stream of liquid may be mostly evaporated by the disc 44. The delivery mechanism 69 may control the amount of liquid in the stream of liquid to achieve a desirable depth of liquid on the disc 44. Preferably, the depth of the liquid is such that most of the liquid on the disc 44 may be evaporated.

Referring now to FIGS. 2–5 and 7, the delivery mechanism 69 for the stream of liquid provided in the base 22 of the illustrated embodiment will be discussed. The base 22 features an upper platform 48 and two lower platforms 50 and 52. The upper platform 48 assists in seating the tank 26 and the housing 32 on the base 22. The first lower platform 50 defines a portion of the reservoir 36. The second lower platform 52 is provided in the base 22 beside the first lower platform 50 and features a lip 58 extending to an edge 60 forming a hole 62 in the second lower platform 52. The hole 62 is arranged and configured to receive the disc 44. The edge 60 surrounding the hole 62 may feature a receiving portion 64 to receive the outer edge 78 of the disc 44. As shown, the entire edge 78 of the disc 44 is connected to the receiving portion 64 on the edge 60 of the hole 62. It will be appreciated that only a portion of the disc 44 need be connected to the base 22 and that the disc 44 may be connected to the base 22 in any suitable manner. For example, any mechanical connection may be used to connect the disc to the base such as adhesive, rivets, welding or a combination thereof.

The delivery mechanism 69 for the stream of liquid is a passageway 70 that connects the reservoir 36 in the first lower platform 50 with the second lower platform 52. The passageway 70 may be a labyrinth with curves or bends. The passageway 70 may feature the entrance 73 at least one bend 72 and the exit 74 that releases liquid onto the lip 58 of the second lower portion 52. The reservoir 36 and passageway 70 may allow a controlled stream of liquid onto the disc 44. Preferably, the stream of liquid is narrow and thin, for example about 3 mm wide by about 0.5 mm thick, such that it provides a thin film of liquid on the top surface 76 of the disc 44. The length of the passageway 70 may act to keep the temperature of the liquid in the tank 26 down by separating the tank 26 and the disc 44. By keeping the temperature down in the tank 26 and reservoir 36, lower grade materials that do not need to withstand higher temperatures may be selected for these parts of the humidifier.

Referring now to FIGS. 6–11, the particular illustrated manner of mounting the disc 44 within the base 22 will be discussed. Referring to the embodiment of FIG. 8, the disc 44 is provided at a particular angle θ relative to a plane W substantially parallel to the flow of the stream of liquid. The angle θ of the disc 44 is provided to keep the stream of liquid flowing on the disc at a desirable depth. The thinner the depth of liquid on the disc 44, the less liquid that needs to be boiled to evaporate. Preferably, the depth of the stream of liquid flowing on the disc 44 at any one point is less than about 8 mm. Preferably, the angle θ is less than about 10°, more preferably between about 0° and about 4°, and most preferably about 2.5°. The distance from the flow of the stream of liquid to the top surface 76 of the disc 44 before angle θ is $D_W$. Preferably, the distance $D_W$ is less than about 8 mm.

The edge 60 of the second lower platform 52 includes a flange 82 and a wall 84. The wall 84 may be the receiving portion 64. As shown, the disc 44 is held within the hole 62 by a friction fit between the gasket 86 provided on the outer edge 78 of the disc 44 and the wall 84 of the second lower platform 52 below the flange 82. The gasket 86 and disc may be held to the base 22 in any other suitable manner including any suitable mechanical connection. For example, the gasket 86 and disc 44 may be glued, riveted or welded to the base 22. One or more brackets may be provided under the edge 60 of the hole 62 to assist in preventing the disc 44 from inadvertently falling or being pushed through the hole 62. Moreover, support ribs may be added to assist the friction fit of the disc 44 in the hole 62. The gasket 86 may be made of rubber. The gasket 86 may feature a groove at the location where the stream of liquid enters onto the disc 44 to assist with flow of liquid onto the disc 44. The top surface 76 of the disc 44 and the gasket 86 may be mounted substantially flush with the second lower platform 52 of the base 22. Although the gasket 86 is shown provided on the entire edge 78 of the disc 44, it will be appreciated that the gasket 86 may be provided on at least a portion of the disc 44. A press may be used to insert the disc 44 and gasket 86 into the hole 62. The wall 84 of the platform 52 at the edge 60 of the hole 62 is provided at the desired angle θ, such that when the disc 44 is inserted into the hole 62 the disc 44 is provided at the desired angle.

Figure 9:
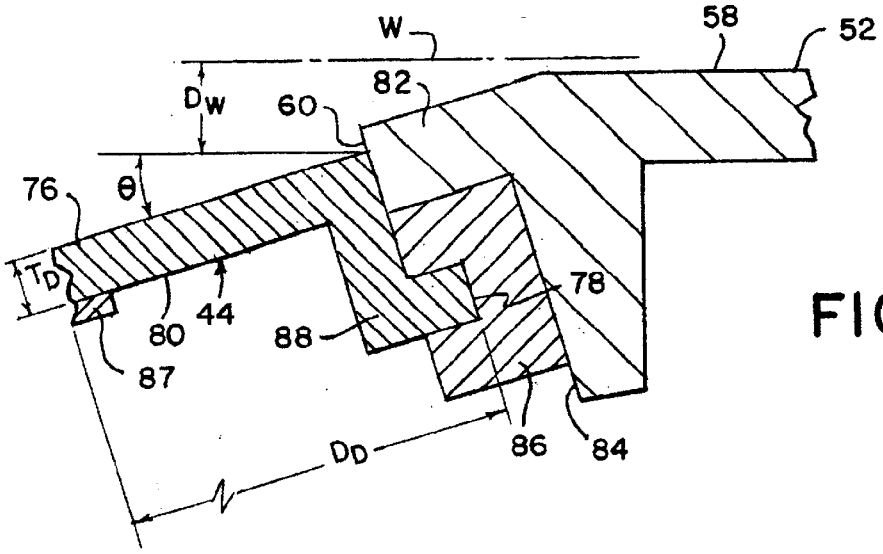
FIG. 9 is a detailed cross-sectional view of another embodiment of a humidification device according to the invention.

FIG. 9 shows another embodiment of the disc 44 according to the present invention. In this embodiment, the top surface 76 of the disc 44 is provided closer to the stream of liquid, such that the distance $D_W$ from the plane W of the flow of the stream of liquid to the disc 44 is less than about 4 mm. Thus, the depth of the liquid on the disc 44 at any one point should be less than about 4 mm. The disc 44 features a disc flange 88 that may be stamped into the outer edge 78 of the disc 44. The disc flange 88 receives the gasket 86 and the disc 44 and gasket 86 are friction fit, as described above, into the hole 62 against the wall 84 of the second lower platform 52. The disc flange 88 raises the height of the top surface 76 of the disc 44 relative to the edge 60 of the platform 52, such that the depth of the liquid on the disc 44 may be reduced.

Figure 8:
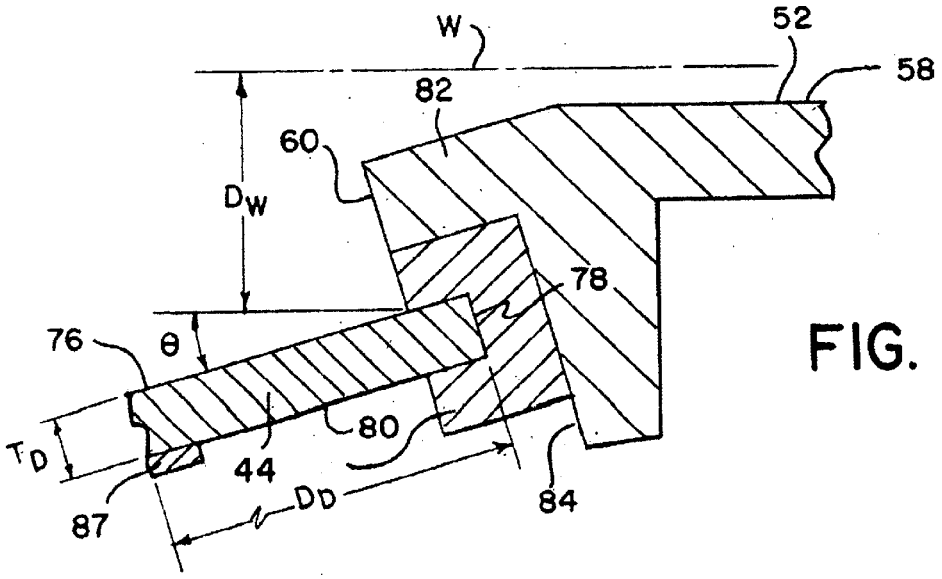
FIG. 8 is a detailed cross-sectional view of one embodiment of a humidification device according to the invention.
Figure 10:
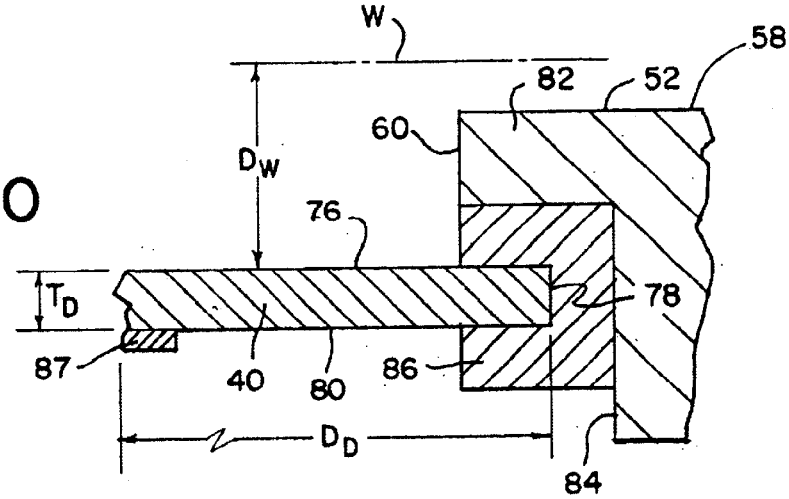
FIG. 10 is a detailed cross-sectional view of yet another embodiment of a humidification device according to the invention.
Figure 11:
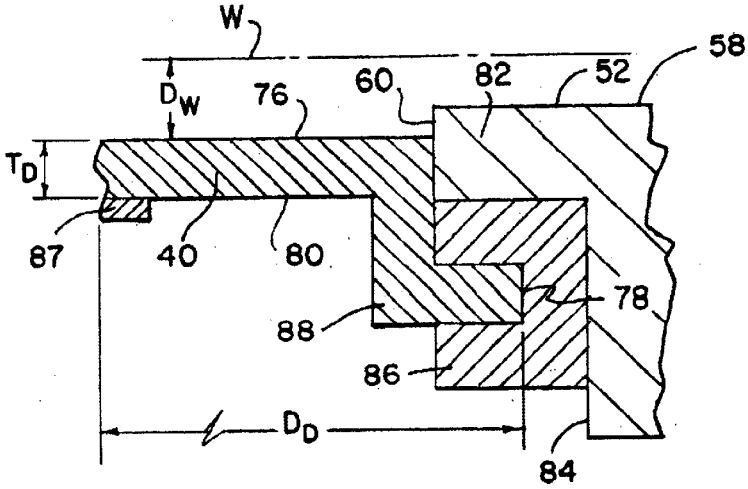
FIG. 11 is a detailed cross-sectional view of yet another embodiment of a humidification device according to the invention.

The embodiments of mounting the disc 44 shown in FIGS. 10 and 11 are substantially similar to FIGS. 8 and 9, except that the disc 44 is provided in a plane substantially parallel to the plane W of the flow of the stream of liquid. Preferably, the disc 44 is in a horizontal plane. The angle θ in the embodiments of FIGS. 10 and 11 is about 0°. Because the disc 44 is provided in a horizontal plane, the flange 82 of the platform 52 at the edge 60 of the hole 62 is provided horizontally with substantially no angle, although an angle may be provided. When the disc 44 is inserted and friction fit into the hole 62, the disc 44 is provided substantially parallel to the plane W of the stream of liquid.

The disc 44 may include an automatic shut-off feature. When the disc 44 reaches a predetermined temperature a switch (not shown) would shut-off the heating mechanism or the power supply to the disc 44 to prevent the disc from overheating. Any suitable means may be used to sense the temperature of the disc 44. For example, the temperature differential on the disc 44 may be measured by a voltage drop across the disc. If a coating is provided on the disc 44, an electrical circuit may be opened at a certain temperature to turn the heating mechanism off. The predetermined temperature at which to shut-off the heating mechanism or power supply to the disc 44 may be determined by the materials used to form the disc 44 and their melting points. Overheating could occur if the storage tank 26 is run out of liquid and no flow of liquid is provided on the disc 44 to cool the disc down by liquid evaporation. A rocker switch may be used to provide the automatic shut-off feature. Other safety features may be included in addition to an automatic switch. For example, an audible signal or light may be provided to alert the user when the storage tank 26 is empty. The light may be a continuous or blinking light, and the audible signal may be a continuous tone or periodic beeping. Similar signals may also readily alert the user as to whether the humidifier 20 is on or off.

The disc 44 may be provided with a cleaning mode. During cleaning mode the temperature of the disc 44 may be spiked to a desired temperature to bake off or dissolve any mineral deposits or other debris left on the disc 44 from the liquid. For example, spiking the temperature may bake off calcium deposits so that the disc 44 may be wiped clean. In another embodiment, the higher temperature of the disc 44 during cleaning mode may cause the deposits to pop off the disc so that the disc may be wiped clean. The cleaning mode may be activated automatically when the reservoir 36 runs out of liquid and no liquid flows through the delivery mechanism 69 onto the disc 44. Thereafter, the heating mechanism or power to the disc 44 may be automatically shut-off as described above. Alternately, the cleaning mode may be activated by the user through controls for the humidifier. Any suitable switch may be used with the disc to activate the cleaning mode. Controls (not shown) for controlling the function of the humidifier may be provided on the base 22 of the humidifier 20, or any other suitable location such as the housing 32. The controls may perform a number of different functions, for example the controls may turn the humidifier on and off, start the cleaning mode and allow the user to select a desired level of humidity.

In use, a user turns the humidifier 20 on and the disc 44 begins to be heated to a predetermined temperature. Once the storage tank 26 is properly placed onto the base 22 and a valve actuator 54 provided in the base 32 opens a valve to start the flow of liquid out of the tank 26, liquid flows from the tank 26 into the reservoir 36 in the base 22. A stream of liquid runs from the reservoir 36 through the passageway 70 to the humidification unit 24, where the stream flows across the lip to the disc 44. The stream of liquid flows across the disc 44 and the heat from the disc 44 causes at least some of the liquid to evaporate. The evaporated liquid is directed upward through the nozzle 38 and is released out of the venturi 40 into the environment. The evaporation occurs as long as the humidifier 20 is turned on and liquid remains in the reservoir 36 to flow to the humidification unit 24. After being turned on and the storage tank 26 is properly placed on the base to start the flow of liquid, the humidifier 20 may reach a state of equilibrium, such that when the liquid reaches a particular depth on the disc 44 it does not increase in depth. Liquid flows from the reservoir through the passageway 70 at a rate to maintain the state of equilibrium.

Other features of the illustrated humidifier will now be discussed for completeness. However, it will be appreciated that the specific features described below are not essential to the invention.

Referring now to FIGS. 2–5 and 7, the base 22 will be discussed. The illustrated base 22 features a smooth external side wall 46. The upper platform 48 assists in seating the tank 26 and the housing 32 on the base 22. The first lower platform 50 defines a portion of the reservoir 36. The first lower platform 50 may feature the valve actuator 54 in the center of the first lower platform 50 to actuate the valve on the storage tank 26. The first lower platform 50 may include seats 56 extending upward from the first lower platform 50. The tank 26 may rest upon these seats 56 to keep space for the reservoir 36 between the tank 26 and the first lower platform 50 when the tank 26 is seated on the base 22.

As discussed above, the second lower platform 52 is provided in the base 22 beside the first lower platform 50 with the lip 58 extending to the edge 60 forming the hole 62 in the second lower platform 52. The hole 62 is arranged and configured to receive the disc 44 as described above. Extending from the second lower platform 52 are extensions 66 with slots 68, the use of the extensions 66 will be discussed later. As described above, the passageway 70 connects the reservoir 36 in the first lower platform 50 with the second lower platform 52. As shown ,the reservoir 36 and passageway 70 may provide a controlled stream of liquid onto the disc 44. As discussed above, the passageway 70 may act to assist in preventing the temperature of the liquid in the tank 26 from rising by separating the tank 26 and the disc 44 by a pre-determined distance.

Figure 3:
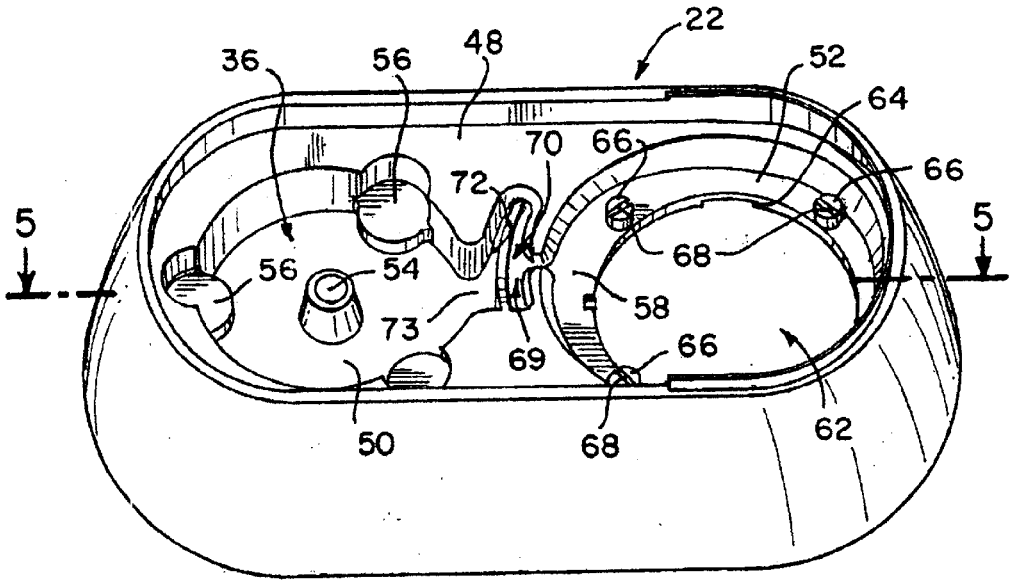
FIG. 3 is a top perspective view of a base of the humidifier of FIG. 1.
Figure 4:
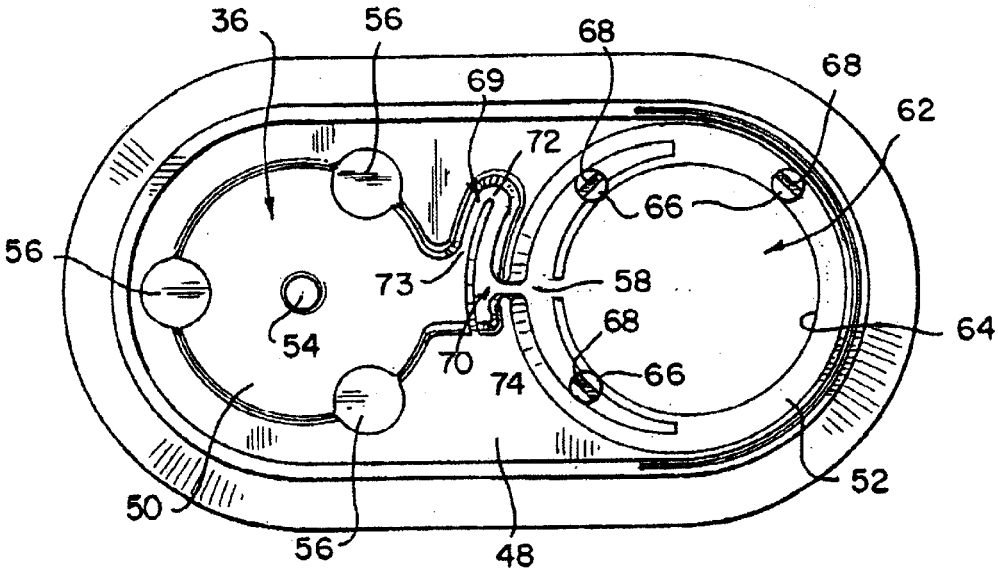
FIG. 4 is a top view of the base of FIG. 3.
Figure 5:
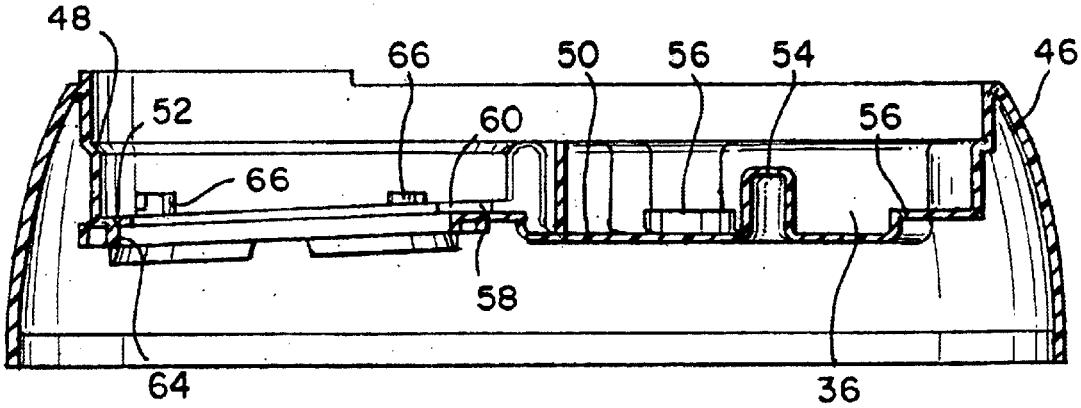
FIG. 5 is a cross-sectional view of the base of FIG. 3 taken along line 5—5
Figure 13:
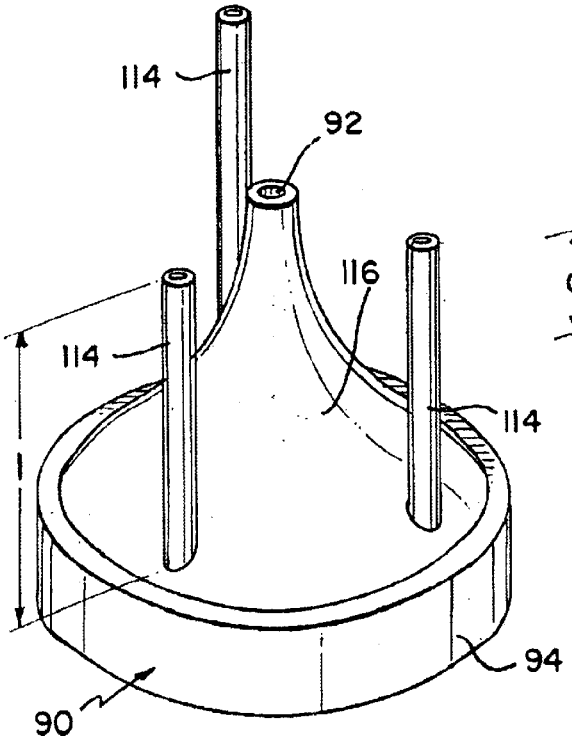
FIG. 13 is a perspective view of one embodiment of a nozzle of the humidification unit of FIG. 1 according to the invention.
Figure 14:
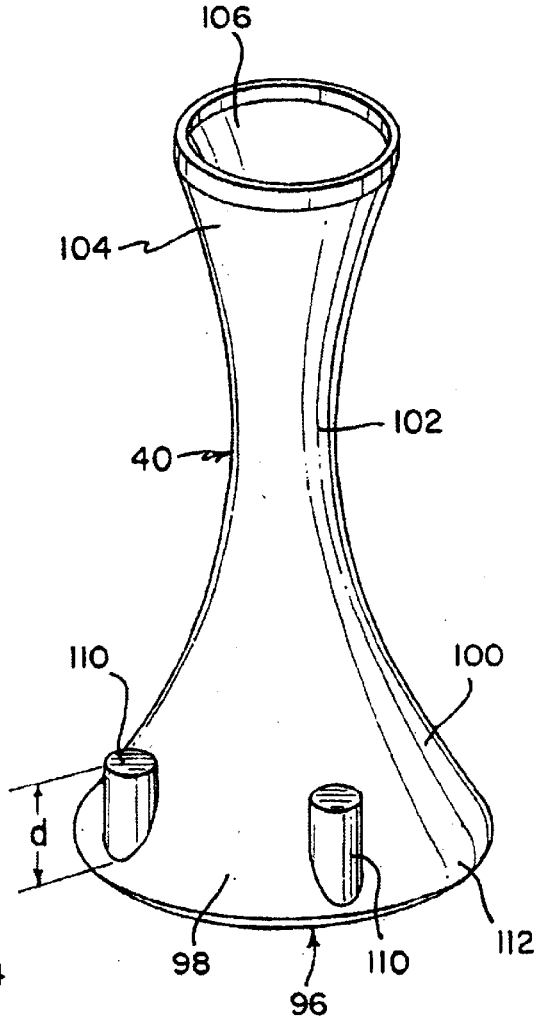
FIG. 14 is a perspective view of one embodiment of a venturi of the humidification unit of FIG. 1 according to the invention.

Referring to FIGS. 13 and 14, embodiments of the nozzle 38 and venturi 40 for use in the present invention are illustrated. As shown in FIG. 13, the nozzle 38 has a funnel-like configuration extending between a large opening 90 and a small opening 92. The nozzle 38 is provided above the disc 44 in the humidification unit 24. The large opening 90 has an outer edge 94 that fits into the base 22 as shown in FIGS. 2 and 7. Referring to FIG. 3, the extensions 66 provided extending from the second lower platform 52 in the base have slots 68 that receive the outer edge 94 of the large opening 90 of the nozzle 38 for securely locating the nozzle 38 to the base 22 around the disc 44.

As shown in FIGS. 2, 7 and 14, the venturi 40 is a hollow cylinder with a large opening 96 at a first end 98. The venturi 40 has a wall 100 that extends and tapers from the large opening 96 at the first end 98 to adjacent the center of the venturi to form a narrow passage 102. The cylinder then expands as it extends from adjacent the center to the second end 104 of the venturi 40 to a second opening 106. As shown, the second opening 106 is smaller than the first large opening 96, however the openings 96 and 106 may be the same or any range of sizes relative to each other. Adjacent the first end 98 of the venturi 40 are small openings 108 in the wall of the cylinder with cup-like portions 110 that extend from an outer surface 112 of the cylinder parallel to a longitudinal axis of the venturi 40. Referring again to FIG. 13, posts 114 are provided extending from an outer surface 116 of the nozzle 38 parallel to a longitudinal axis of the nozzle 38. As shown in FIGS. 2 and 7, the venturi 40 is placed over the nozzle 38 and the cup-like portions 110 of the venturi 40 are aligned with the posts 114 of the nozzle 38. The posts 114 are inserted into the cup-like portions 110 to hold the venturi 40 above the nozzle 38 at a desired distance. The length l of the posts 114 and the depth d of the cup-like portions 110 assist in locating the venturi 40 at a particular height h above the nozzle 38.

As shown in FIG. 2, the venturi 40 is not centered over the nozzle 38 and is instead offset, such that the centerline N of the nozzle 38 does not align with the centerline V of the venturi 40. It will, however, be appreciated that the venturi 40 and the nozzle 38 may be centered with respect to each other. The particular nozzle and venturi configuration are described and illustrated for exemplary purposes only, any suitable nozzle and venturi configuration may be used with the present invention. Moreover, it will be appreciated that any suitable mechanism for dispersing the evaporated liquid into the environment may be used, not merely a nozzle and venturi configuration. For example, a fan may be used to move the evaporated liquid out of the humidification unit 24.

As shown in FIGS. 1, 2 and 7 the housing 32 is placed over the venturi and nozzle assembly against the upper platform 48 of the base 22 to cover the humidification unit 24. The housing 32 has a cone-like shape, with a wide opening 118 in the lower portion 30 of the housing 32 for mating with the base 22 around the nozzle 38 and disc 44. The top of the housing 32 includes the outlet 34. The second opening 106 of the venturi 40 is aligned with the outlet 34 of the housing 32 so that the evaporated liquid may be released through the second opening 106 and outlet 34 and into the surrounding environment. The venturi 40 may extend partially though the outlet 34 in the housing 32. Adjacent the lower portion 30 of the housing 32, one or more air inlets 28 are provided. As shown, the air inlets 28 may be provided on opposite sides of the lower portion 30 of the housing 32 as a number of extended slots 120 through the housing wall. The slots 120 are provided through the lower portion 30 of the housing 32 adjacent to where the nozzle 38 is located, such that air may be taken in through the inlets 28 to mix with the evaporated liquid as it exits the nozzle 38 and is released out the venturi 40 through the second opening 106 and the outlet 34 in the housing 32. Although a particular housing configuration has been shown and described, it will be appreciated that the housing may have any suitable configuration.

Now, referring to FIGS. 1, 2 and 7, the removable liquid storage tank 26 will be described. The tank 26 is sealed and includes a carrying handle 122 on its top surface 124 while a bottom surface 126 includes an opening 128 to which a cap 130 is attached. When the tank 26 is inverted beneath a spigot or faucet and the cap 130 is removed the opening 128 serves as a fill opening 132. The cap 130 includes a valve system (not shown) that seals the fill opening 132 unless the tank 26 is properly positioned on a humidifier base 22 and the valve is engaged by a valve actuator 54 in the base 22. The valve actuator 54 opens the valve and allows liquid to escape from the tank 26 into the reservoir 36 defined by the base 22. Discharging liquid is exchanged for air, which enters the tank 26 from the same opening. As liquid flows into the reservoir 36 the liquid level rises until it seals the valve and prevents air from getting into the tank 26. At this level, which is the normal operating liquid level for the humidifier 20, liquid flow from the tank 26 ceases.

During use of the humidifier 20, the tank 26 is used to maintain a constant source of liquid for humidification. After exhaustion of its liquid contents, the tank 26 is removed from the base 22 and transported to a suitable tap or faucet. The tank 26 is then inverted and the cap 130 is removed from the threaded outlet sleeve 134. After re-filling the tank 26, the cap 130 is replaced on the threaded outlet sleeve 134 and the tank 26 is carried back to the humidifier 20 and positioned appropriately on the base 22. During refilling, the user can employ the handle 122 as desired. The preferred liquid for use in the humidifier 20 is water.

Although a specific storage tank is shown in described, it will be understood that the storage tank 26 may be of any suitable size, shape and configuration. For example, the tank may be provided surrounding at least a portion of the venturi 40 and/or nozzle 38. Moreover, the supply of liquid may be pumped into the reservoir 36 using a mechanical or electrical pump. The tank 26 may be provided separately from the humidifier 20. Although the humidifier 20 is shown and described with a removable storage tank 26, it will be appreciated that the supply of liquid to the reservoir 36 in the base 22 may come from any suitable source. For example, the humidifier 20 may be connected directly, or through a hose, to a tap, faucet or other liquid container or source for its liquid supply.

The humidifier 20 may be manufactured and assembled by known processes. For example, the base 22, liquid storage tank 26, and housing 32, nozzle 38 and venturi 40 for the humidification unit 24 may be molded from suitable plastics. Preferably, the rubber gasket 86 is provided on the outer circumference of the disc 44 and a press is used to friction fit the combination into the disc hole 62 in the base 22.

Modifications and improvements within the scope of this invention will occur to those skilled in the art. The above description is intended to be exemplary only. The scope of the invention is defined only by the following claims and their equivalents.

What is claimed is:

1. A humidifier comprising:

a base defining a reservoir for retaining liquid;

a heatable disc having a surface for receiving a stream of liquid from the reservoir on the surface of the disc;

a mechanism for delivering the stream of liquid from the reservoir to the disc, said mechanism delivering at least a portion of the stream of liquid as an atomized mist; and wherein the disc is constructed and arranged to evaporate at least a portion of the stream of liquid withdrawn from the reservoir and discharge the moisture into the environment.

2. The humidifier of claim 1, wherein the disc is angled below a horizontal plane in which the stream of liquid is delivered.

3. The humidifier of claim 2, wherein the angle is less than about 10°.

4. The humidifier of claim 2, wherein the angle is about 2.5°.

5. The humidifier of claim 1, wherein at least a portion of the disc is connected to the base adjacent to where the disc receives the stream of liquid.

6. The humidifier of claim 5, wherein the disc has an edge and the entire edge of the disc is connected to the base.

7. The humidifier of claim 5, further comprising a gasket holding the disc to the base.

8. The humidifier of claim 6, wherein the disc is held to the base by a friction fit.

9. The humidifier of claim 1, wherein the surface of the disc is a top surface.

10. The humidifier of claim 9, further comprising:

an extended portion provided on the disc to move the surface of the disc closer to a plane through which the stream of liquid from the reservoir substantially flows.

11. The humidifier of claim 1, wherein the disc is stainless steel.

12. The humidifier of claim 11, wherein the disc has a surface that includes a coating.

13. The humidifier of claim 1, wherein the disc is substantially round.

14. The humidifier of claim 1, wherein at least a portion of the disc is substantially flat.

15. The humidifier of claim 1, wherein the disc includes an electrical resistance coil and the coil is connectable to an electrical source for heating at least a portion of the surface of the disc.

16. The humidifier of claim 1, wherein the disc is constructed and arranged to have a cleaning mode for spiking the temperature of at least a portion of the surface of the disc.

17. The humidifier of claim 16, wherein the disc automatically enters the cleaning mode when the reservoir is empty.

18. The humidifier of claim 1, wherein the disc is constructed and arranged to automatically shut-off the heat when at least a portion of the surface of the disc reaches a predetermined temperature.

19. The humidifier of claim 1, wherein the mechanism for delivering the stream of liquid includes a passageway provided between the reservoir and the disc.

20. The humidifier of claim 19, wherein the passageway includes a labyrinth.

21. The humidifier of claim 1, wherein the mechanism for delivering the stream of liquid includes an atomizer.

22. The humidifier of claim 1, wherein the liquid received on the surface of the disc has a depth and the depth is less than about 8 mm.

23. The humidifier of claim 1, wherein the mechanism for delivering the stream of liquid delivers at least a portion of the stream of liquid as a thin film.

24. The humidifier of claim 1, wherein the mechanism for delivering the stream of liquid delivers at least a portion of the stream of liquid as a controlled stream.

25. The humidifier of claim 1, wherein liquid not evaporated on the disc is returned to the reservoir.

26. The humidifier of claim 1, further comprising:

a nozzle provided above the disc to direct the evaporated liquid through the nozzle; and a venturi to release the evaporated liquid out of the humidifier.

27. The humidifier of claim 1, further comprising:

a liquid storage tank having an outlet communicating with the reservoir and adapted to feed liquid thereto.

28. The humidifier of claim 27, wherein the tank is removably provided on the base.

* * * * *